United States Patent [19]

Kajita et al.

[11] Patent Number: 4,502,779

[45] Date of Patent: Mar. 5, 1985

[54] CLEANING DEVICE FOR ELECTROSTATIC COPYING MACHINES

[75] Inventors: Hiroshi Kajita; Tadanobu Nakajima; Masahide Iseki, all of Osaka, Japan

[73] Assignee: Mita Industrial Company Limited, Osaka, Japan

[21] Appl. No.: 442,049

[22] Filed: Nov. 16, 1982

[30] Foreign Application Priority Data

Nov. 27, 1981 [JP] Japan ..... 56-191276

[51] Int. Cl.[3] ..... G03G 15/00; G03G 21/00

[52] U.S. Cl. ..... 355/15; 15/256.51; 15/256.53

[58] Field of Search ..... 355/3 R, 15; 15/256.51, 15/256.52, 256.53

[56] References Cited

U.S. PATENT DOCUMENTS 3,742,551 7/1973 Oriel ..... 15/256.51
3,871,762 3/1975 Van Der Vlasakker .... 15/256.51 X
4,171,157 10/1979 Suzuki .
4,297,026 10/1981 Honda et al. ..... 15/256.51 X
4,364,660 12/1982 Oda ..... 15/256.51 X
4,400,082 8/1983 Kiba ..... 15/256.53 X

*Primary Examiner*—Fred L. Braun
*Attorney, Agent, or Firm*—Wenderoth, Lind & Ponack

[57] ABSTRACT

A cleaning device for use in an electrostatic copying machine removes with a blade any residual toner from a photosensitive body after a toner image has been transferred therefrom to a sheet of copying paper. A support shaft supports the blade for slidable contact with the photosensitive body and has a horizontal axis extending perpendicularly to a direction of travel of the photosensitive body. The support shaft is angularly movable about the axis and is axially movable. A rotational shaft is rotatable about an axis parallel to the support shaft. A first device converts rotational movement of the rotational shaft into reciprocal movement along the axis of the support shaft. A second device converts rotational movement of the rotational shaft into reciprocal angular movement of the support shaft. A third device releases interconnection between the rotational shaft and the first and second devices.

7 Claims, 13 Drawing Figures

23
24
25
95
81
80
22

7
10
11
37
48a
40
39
41
49
54
59
34
36
48b
37
35
56
58
57
78

CLEANING DEVICE FOR ELECTROSTATIC COPYING MACHINES

BACKGROUND OF THE INVENTION

1. Field of the Invention

The present invention relates to a cleaning device for an electrostatic copying machine, and more particularly to a cleaning device having a blade for scraping off any residual developer from a photosensitive body after a developed image has been transferred.

2. Description of the Prior Art

In a prior art arrangement, a cleaning device comprises a blade held in slidable contact with the surface of a photosensitive body and reciprocally movable transversely with respect to the direction of movement of the photosensitive body during a copying operation for preventing the surface of the photosensitive body from being damaged as much as possible. The blade is also movable into and out of contact with the surface of the photosensitive body to allow a magnetic brush to collect the developer caught by the blade. Such prior cleaning device requires means for driving the blade for the reciprocal transverse movement and separate means for driving the blade for the selective movement into and out of contact with the photosensitive body, and thus is composed of an increased number of parts and is complex in consrtuction.

It is an object of the present invention to provide a cleaning device for electrostatic copying machines which is of a simpler structure for driving a blade reliably in ganged reciprocal movement and movement into and out of contact with a photosensitive body.

SUMMARY OF THE INVENTION

The above object is achieved in accordance with the present invention by providing a cleaning device for use in an electrostatic copying machine and including a support shaft supporting a blade for slidable contact with the photosensitive body and having a horizontal axis extending perpendicularly or orthogonally to a direction of travel of the photosensitive body, the support shaft being angularly movable about the axis and axially movable, a rotational shaft rotatable about an axis parallel to the support shaft, first means for converting rotational movement of the rotational shaft into reciprocal movement along the axis of the support shaft, second means for converting rotational movement of the rotational shaft into reciprocal angular movement of the support shaft, and third means for releasing interconnection between the rotational shaft and the first and second means.

According to the present invention, the blade is driven for reciprocal movement to prevent the surface of the photosensitive body from being damaged as much as possible and also for movement into and out of contact with the surface of the photosensitive body, to enable collection by a magnetic brush of any developer caught by the blade, such movements of the blade being effected in ganged relation. With this arrangement, it is not ncecessary to provide a plurality of means for driving the blade for the different movements, and hence the cleaning device is composed a reduced number of parts and is simple in structure. The movements of the blade can be performed reliably at timed intervals.

According to an embodiment of the present invention, the first means comprises a face cam rotatable about an axis parallel to the rotational shaft and having cam faces projecting through different lengths along the last-mentioned axis and varying circumferentially along the face cam, and a cam follower mounted on an end of the support shaft and resiliently held against the cam faces.

The second means comprises a rotatable disk having a cam face and mounted on the rotational shaft, and lever means having one end operatively coupled to the support shaft and on the other end a cam follower resiliently held against the cam face for transmitting rotational movement of the rotatable disk to the support shaft.

The third means comprises a solenoid-operated plunger energizable each time the photosensitive drum makes one revolution, and a clutch interposed between the first means and the rotational shaft for controlling the rotational movement from the rotational shaft to the second means in response to energization of the solenoid-operated plunger.

BRIEF DESCRIPTION OF THE DRAWINGS

A detailed description of the invention now will be made with reference to the accompanying drawings, wherein like numerals designate corresponding parts in the figures, and wherein.

DETAILED DESCRIPTION OF THE PREFERRED EMBODIMENT

Figure 1:
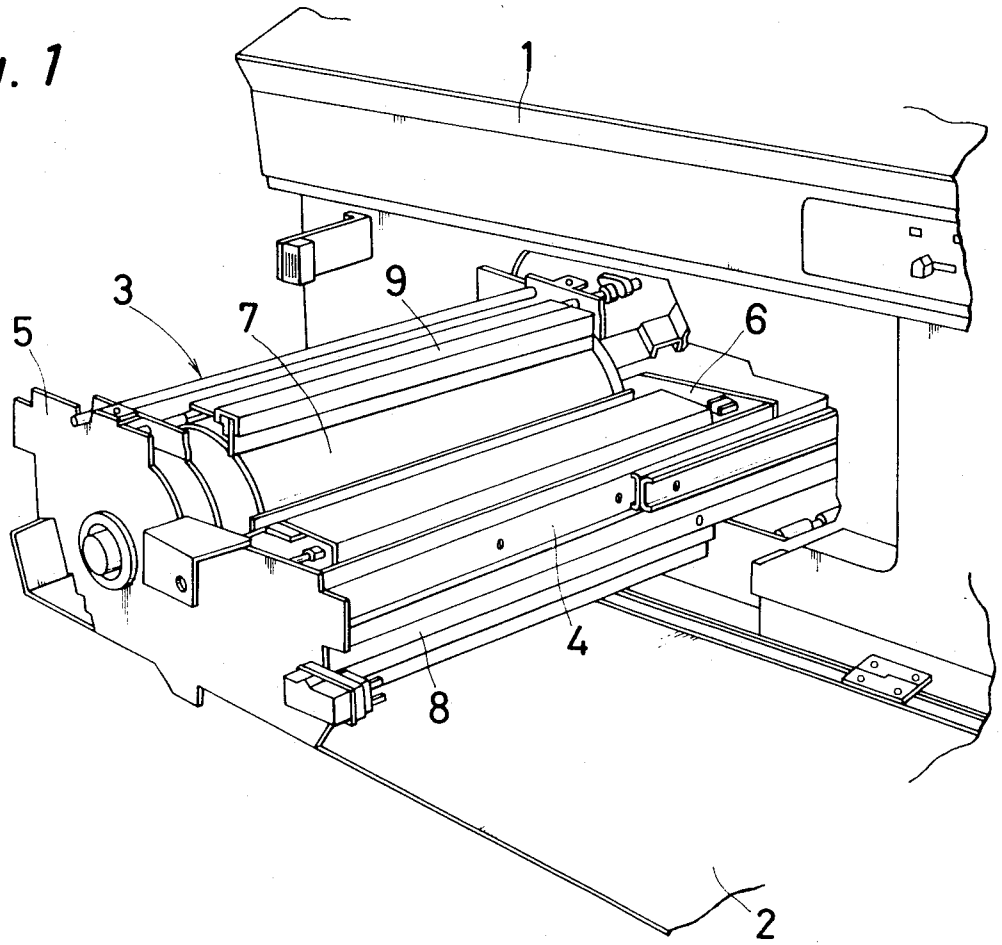
FIG. 1 is a fragmentary perspective view of a cleaning device according to the present invention.

As shown in FIG. 1, a transfer-type electrostatic copying machine has a machine frame 1 with an openable cover 2 and a movable unit 3 which can be pulled out along a guide rail 4 when the cover 2 is opened. The movable unit 3 includes a photosensitive drum 7 supported between a pair of side plates 5, 6, and a development unit 8 and a cleaning device 9 disposed around the photosensitive drum 7.

Figure 2:
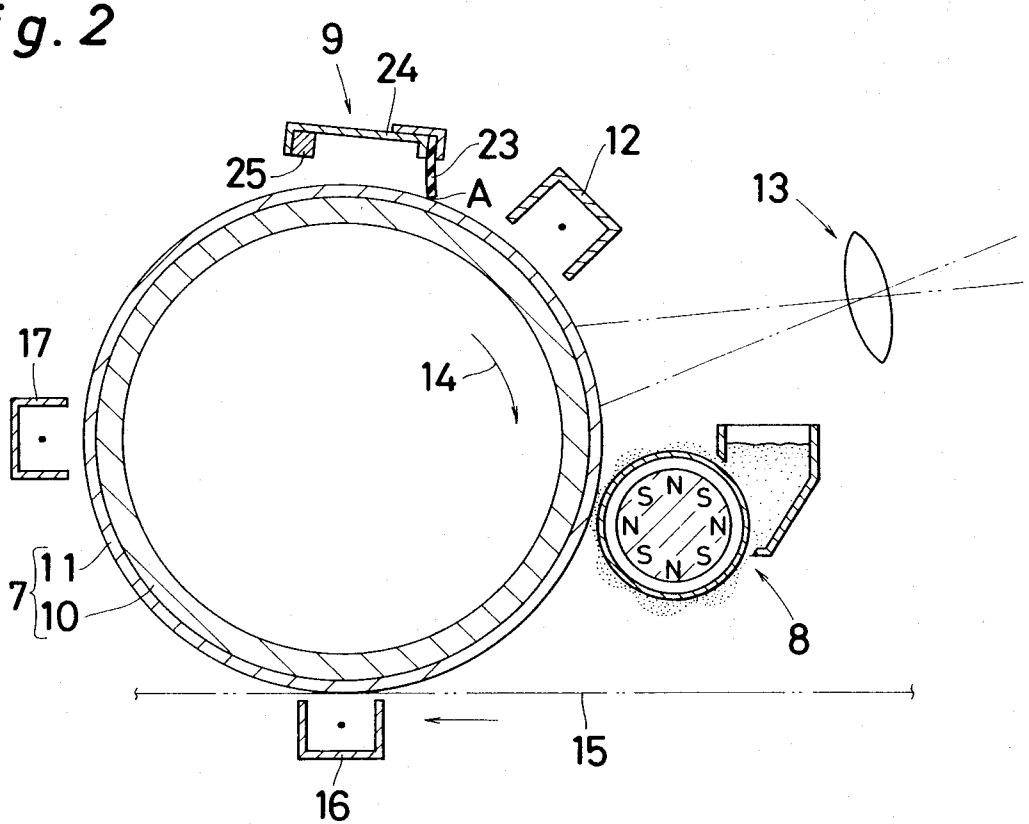
FIG. 2 is a vertical cross-sectional view of a photosensitive drum and components disposed therearound.

FIG. 2 shows, in cross section, the photosensitive drum 7 and other components located in surrounding relation thereto. The photosensitive drum 7 is composed of a cylindrical body 10 and a photosensitive layer 11 mounted on the outer circumference of the cylindrical body 10, and is rotatably movable in the direction of the arrow 14. In a copying operation, the photosenstive layer 11 is charged by a corona discharger 12, and an electrostatic latent image is formed on the photosensitive layer 11 by an exposure unit 13 based on an optical image of an original (not shown) to be copied. The electrostatic latent image is rendered visible by the development unit 8 to form a toner image on the photosensitive layer 11 in a pattern corresponding to the original. The development unit 8 utilizes a single-component or dual-component developer to effect image development. The toner image as formed on the photosensitive layer 11 is transferred by a corona discharger 16 onto a sheet of copying paper which travels along a path 15. The toner image which has been transferred to the sheet of copying paper is then fixed by a fixing unit (not shown) at a following stage. The sheet of copying paper with the fixed image is thereafter discharged out of the machine frame 1. The photosensitive layer 11 from which the toner image has been transferred is discharged by a corona discharger 17, and any residual toner is removed from the photosensitive layer 11 by the cleaning device 9.

Figure 3:
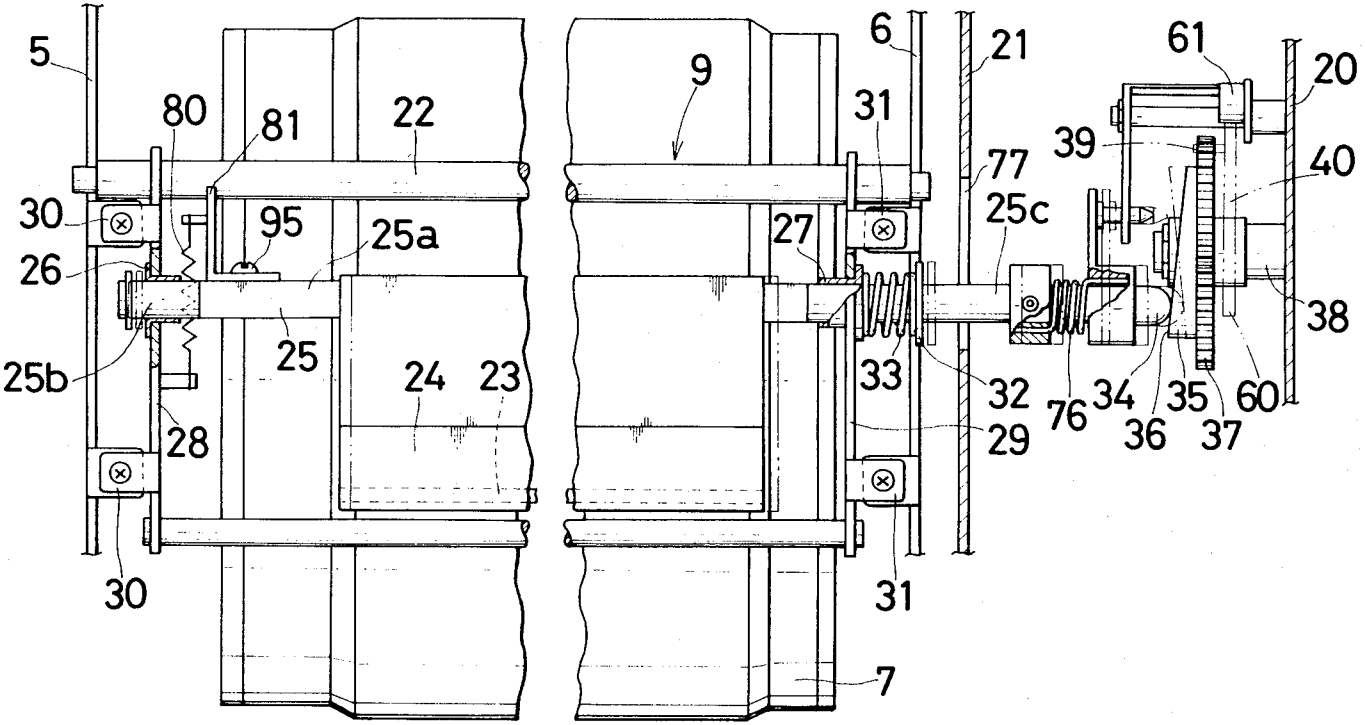
FIG. 3 is a fragmentary horizontal cross-sectional view of the cleaning device.
Figure 4:
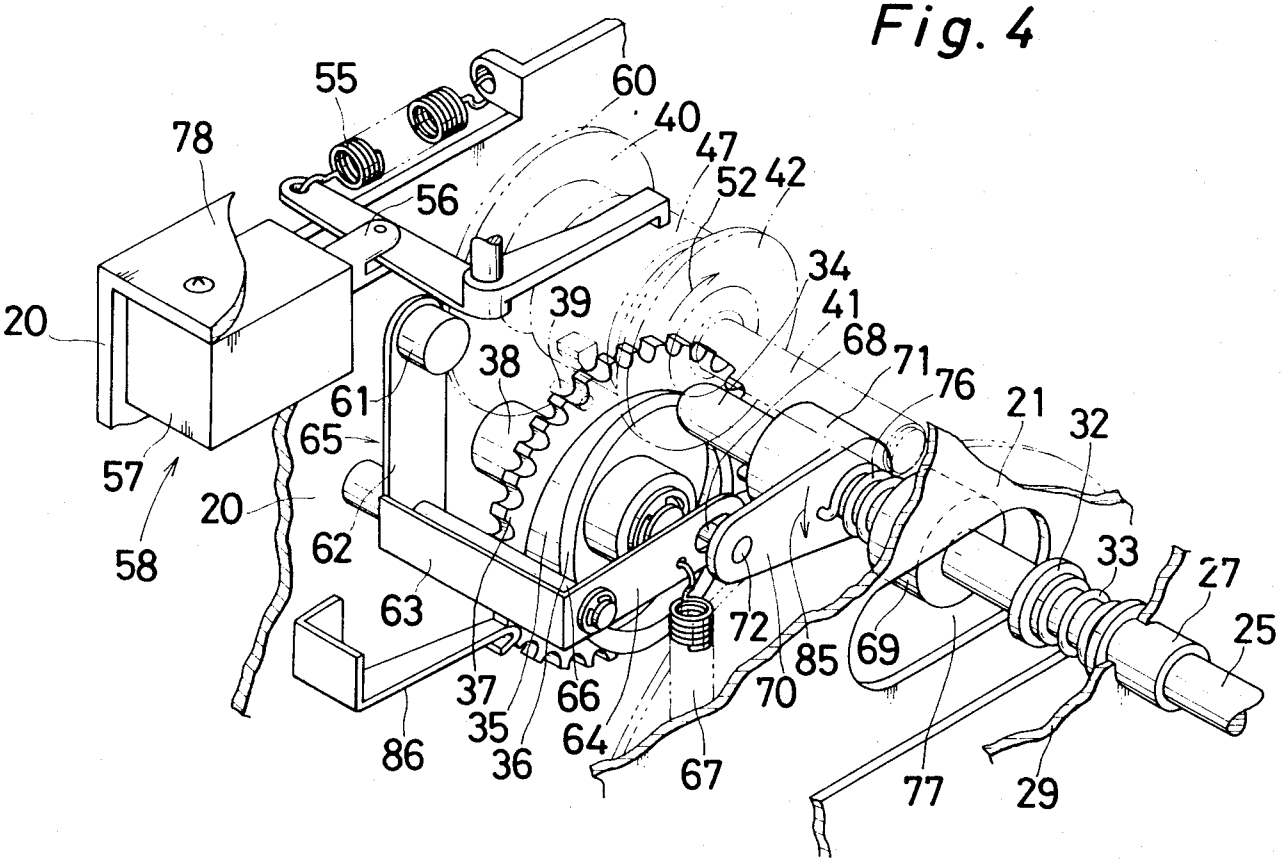
FIG. 4 is a fragmentary perspective view of a cam follower, a face cam and associated parts.
Figure 5:
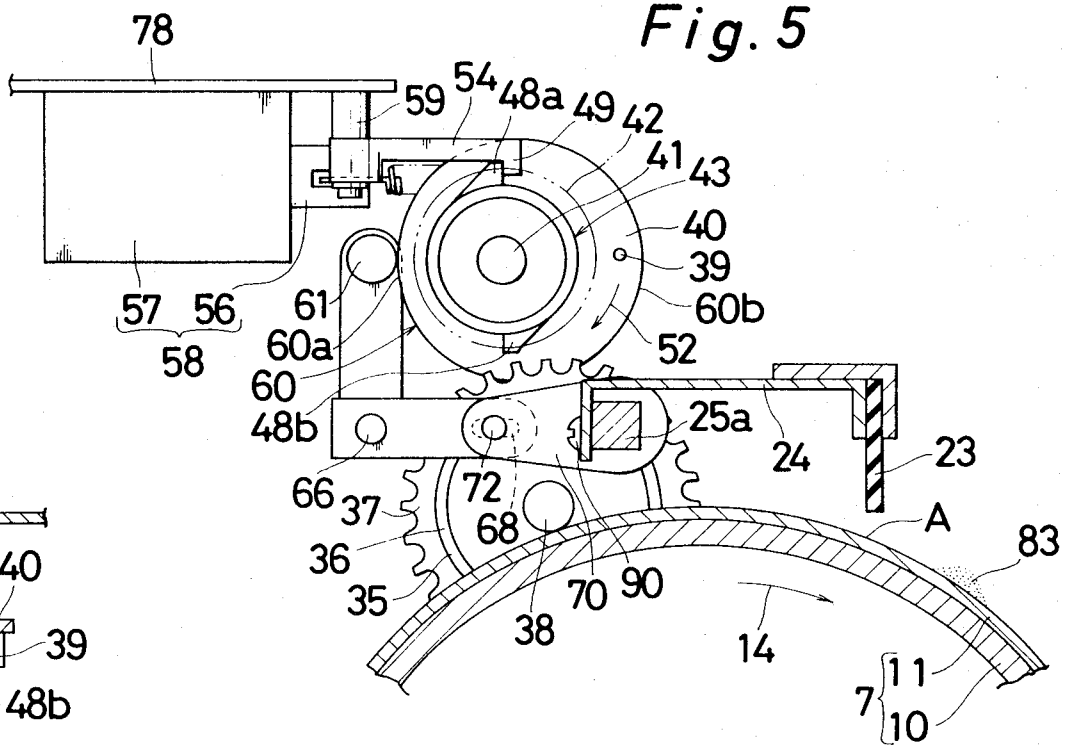
FIG. 5 is a side elevational view, partly in cross section, of the face cam, a rotatable disk and other components.

FIGS. 3 and 4 show the cleaning device 9 in more detail. A back plate 20 and a rear side plate 21 are disposed behind the machine frame 1. A stay 22 is attached to and extends between the side plates 5, 6 of the movable unit 3. As illustrated in FIG. 5, a blade 23 that can contact the photosensitive layer 11 is made of a flexible material such as urethane rubber and extends axially of the photosensitive drum 7 along the full length of the photosensitive layer 11. The blade 23 is fixed to a blade holder 24 which is fastened by a pin 90 centrally to a portion 25*a* of a support shaft 25 which has a rectangular cross section. The blade holder 24 is allowed to swing slightly about the axis of the pin 90. The support shaft 25 includes end portions 25*b*, 25*c* of a circular cross section which are rotatably journalled in bearings 26, 27, respectively, that are mounted on attachment plates 28, 29 extending parallel to the side plates 5, 6. The attachment plates 28, 29 are secured respectively by brackets 30, 31 to the side plates 5, 6, respectively, of the movable unit 3. The end portion 25*c* of the support shaft 25 has thereon a retaining ring 32. A coil spring 33 is disposed around the end portion 25*c* between the retaining ring 32 and the bearing 27 for normally urging the support shaft 25 to move to the right as shown in FIG. 3. The distal end of the end portion 25*c* terminates in a cam follower 34 held in contact with a cam face 36 of a face cam 35. When the movable unit 3 is mounted in the machine frame 1 as shown in FIG. 3 so as to be ready for copying operations, the cam follower 34 is resiliently held against the cam face 36 under the resiliency of the spring 33.

The face cam 35 is affixed concentrically to a gear 37 rotatably mounted by a shaft 38 secured to the back plate 20. A leaf spring 86 (FIG. 4) has a proximal end fixed to the back plate 20 and a distal end held in resilient engagement with one tooth at a time of the teeth of the gear 37. Thus the gear 37 is prevented by the leaf spring 86 from freely rotating on the shaft 38. As shown in FIG. 5, a rotatable disk 40 having a pin 39 that can engage one of the teeth of the gear 37 at a time is fitted over a shaft 41 rotatably supported between the back plate 20 and the rear side plate 21. A sprocket wheel 42 is also fitted over the shaft 41 and rotatable with respect thereto.

Figure 6:
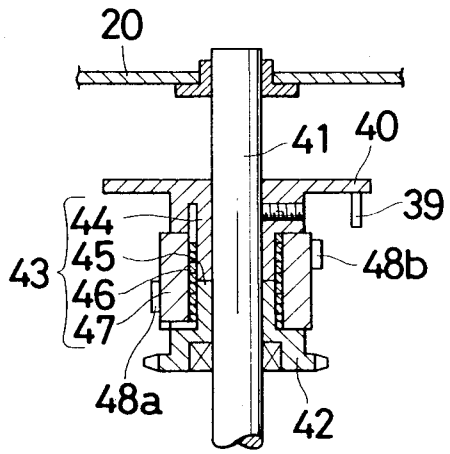
FIG. 6 is a cross-sectional view of a spring clutch.
Figure 7:
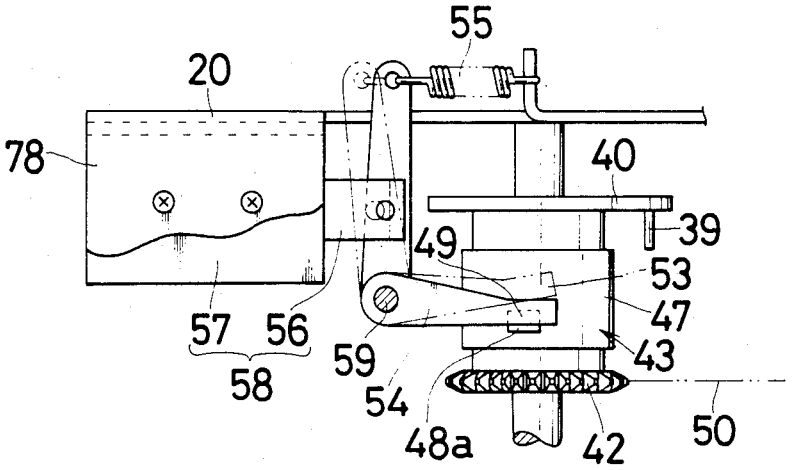
FIG. 7 is a plan view of the spring clutch and associated parts.

FIGS. 6 and 7 illustrate a spring clutch 43 interposed between the rotatable disk 40 and the sprocket wheel 42. The spring clutch 43 comprises a coil spring 46 disposed between a hub 44 of the rotatable disk 40 and a hub 45 of the sprocket wheel 42, a ratchet wheel 47 extending around the coil spring 46, and a pawl 49 engageable with one of a pair of teeth 48*a*, 48*b* disposed in diametrically opposite and axially spaced relation on the ratchet wheel 47. The coil spring 46 has one end secured to the rotatable disk 40 and the other end to the ratchet wheel 47. A chain 50 is trained around the sprocket wheel 42 and a sprocket 51 (shown in FIG. 13) mounted coaxially with the photosensitive drum 7 for rotating the latter. Thus the sprocket wheel 42 can be driven to rotate in the direction of the arrow 52 (FIG. 5) in response to rotation of the photosensitive drum 7.

As illustrated in FIG. 7, when the pawl 49 engages the tooth 48*a* on the ratchet wheel 47, the coil spring 46 fails to be clamped around the hub 45 of the sprocket wheel 42, and hence the rotatable disk 40 remains at rest. When the pawl 49 is displaced to the imaginary-line position 53 as shown in FIG. 7 to bring the pawl 49 out of engagement with the tooth 48*a* on the ratchet wheel 47, the ratchet wheel 47 starts to rotate with the sprocket wheel 42, whereupon the hub 45 is clamped by the coil spring 46. Rotative power is then transmitted from the sprocket wheel 42 through the hub 45 to the hub 44 via the coil spring 46 to rotate the rotatable disk 40 in the direction of the arrow 52.

The pawl 49 is formed on one end of a substantially L-shaped lever 54, the other end of which is urged by a spring 55 in a direction to bring the pawl 49 into engagement with the tooth 48*a*. The lever 54 is rotatably mounted by a pin 59 on a bracket 78 extending from the back plate 20. A solenoid-operated plunger 58 is supported on the bracket 78 and includes a plunger 56 and a solenoid 57. The plunger 56 is operatively coupled to the lever 54 by a pin. When the solenoid 57 is energized, the plunger 56 is displaced to the left (as shown in FIGS. 5 and 7), the pawl 49 is moved out of engagement with the tooth 48*a*.

In FIGS. 4 and 5, the rotatable disk 40 has peripheral cam face 60 including a minimum-radius portion 60*a* and a maximum-radius portion 60*b*, the pin 39 being secured to the rotatable disk 40 adjacent to the maximum-radius portion 60*b*. A cam follower 61 is held in abutment against the cam face 60 and is mounted on a lever 65 composed of a first swing arm 62, a joint portion 63, and a second swing arm 64, the cam follower 61 being affixed to a distal end of the first swing arm 62. The lever 65 is angularly movably supported on a shaft 66 secured to the back plate 20. The second swing arm 64 is connected to a spring 67 which normally urges the second swing arm 64 to turn clockwise (FIG. 4) about the shaft 66 for keeping the cam follower 61 resiliently against the cam face 60. The second swing arm 64 has a slot 68 extending radially of the shaft 66.

Figure 8:
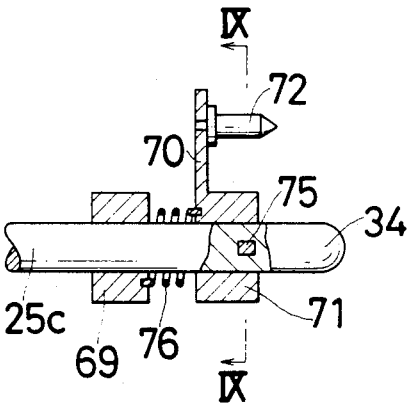
FIG. 8 is a cross-sectional view of the follower and adjacent components.

As shown in FIG. 8, a stopper 69 is secured to the end portion 25*c* of the shaft 25 adjacent to the cam follower 34. A lever 70 has a hub 71 fitted over the end portion 25*c* for angular movement relative thereto and located more closely than the stopper 69 to the cam follower 34. The lever 70 has on its distal end a pin 72 with a tapered end. The pin 72 can be inserted through the slot 68 in the second swing arm 64 of the lever 65.

Figure 9:
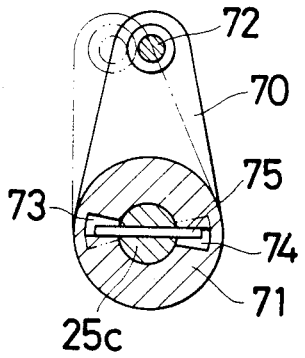
FIG. 9 is an enlarged cross-sectional view taken along the line IX—IX of FIG. 8.

In FIG. 9, the hub 71 has a pair of substantially sectorial cavities 73, 74 opening toward the cam follower 34 and located in diametrically opposite relation across the end portion 25c. A pin 75 extends diametrically through the end portion 25c and has ends disposed respectively in the cavities 73, 74. The support shaft 25 and the lever 70 are angularly movable relatively to each other between the solid-line position and the imaginary-line position as shown in FIG. 9. A coil spring 76 is interposed between the stopper 69 and the lever 70 and has one end engaging the stopper 69 and the other end engaging the hub 71 of the lever 70. The rear side plate 21 has a hole 77 (FIGS. 3 and 4) through which the lever 70 can pass when the movable unit 3 is pulled out of the machine frame 1 as shown in FIG. 1.

Figures 10, 11:
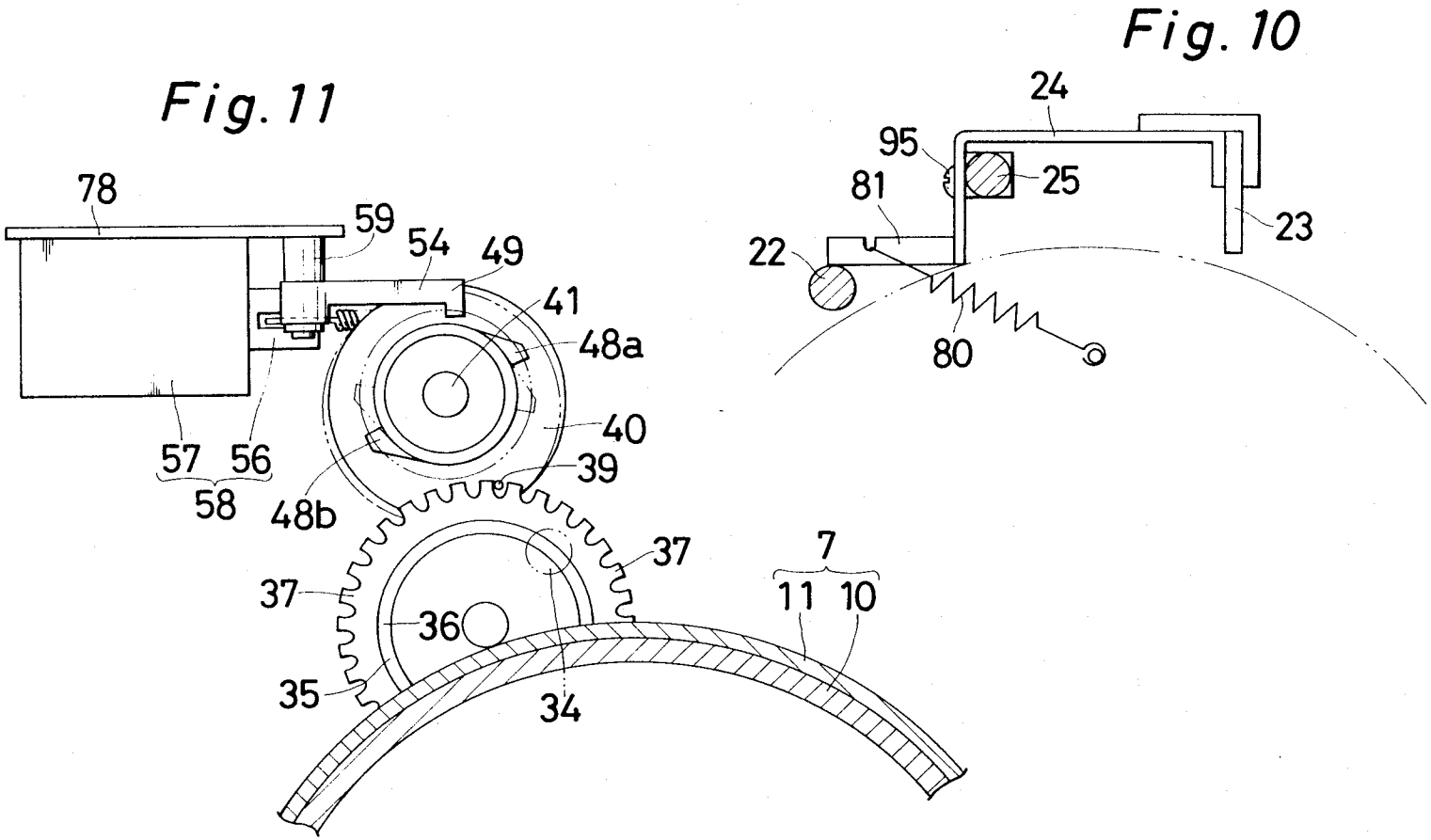
FIG. 10 is a side elevational view of a blade.
FIG. 11 is a side sectional view similar to FIG. 5, showing another mode of operation.

As illustrated in FIGS. 3 and 10, a stopper 81 is fastened by a screw 95 to the support shaft 25 and is resiliently held against an upper surface of the stay 22 under the force of a spring 80. The stopper 81 serves to limit angular movement of the blade holder 24 to a certain angle about the axis of the support shaft 25.

Operation of the cleaning device 9 thus constructed is as follows: while the solenoid 57 of the solenoid-operated plunger 58 remains de-energized with the movable unit 3 disposed in the machine frame 1, the pawl 49 is held in engagement with the tooth 48a of the spring clutch 43. The rotatable disk 40 is therefore prevented from rotation even when the photosensitive drum 7 is rotated. Assuming that the cam follower 61 is held in contact with the minimum-radius portion 60a of the cam face 60 at this time, the blade 23 is spaced from the photosensitive layer 11 of the photosensitive drum 7 under the resiliency of the spring 80.

Figure 12:
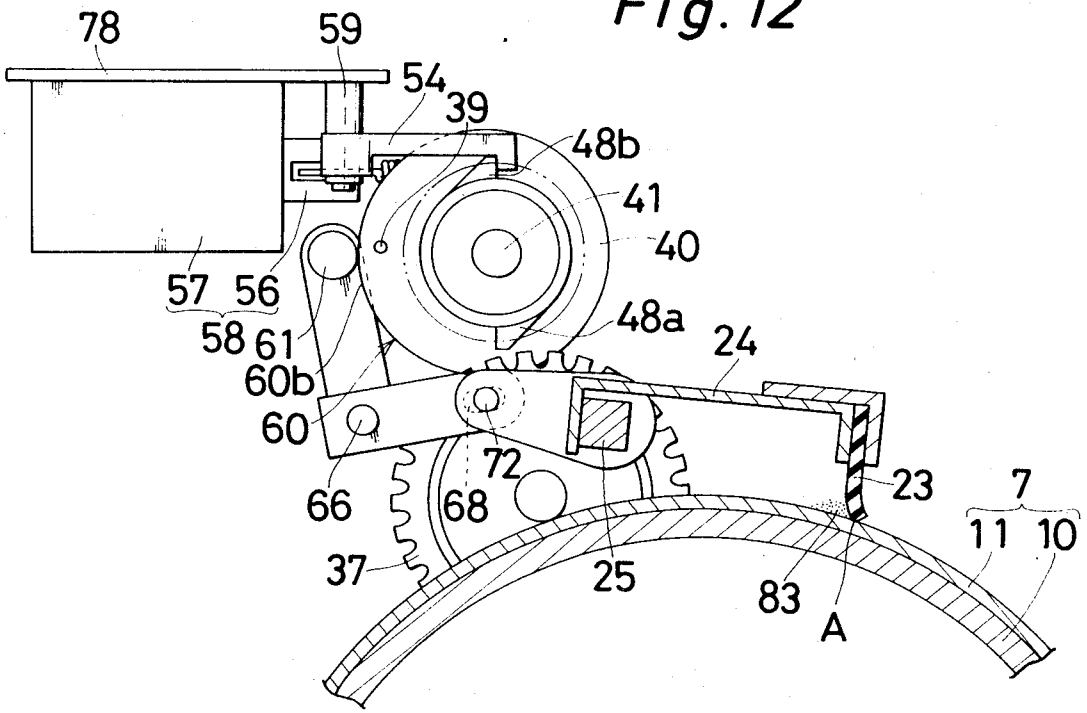
FIG. 12 is a side elevational view similar to FIGS. 5 and 11, showing still another mode of operation.

The solenoid 57 of the solenoid-operated plunger 58 is energized before a front end of an area of the photosensitive layer 11 on which the electrostatic image has been formed or on which any residual toner tends to remain reaches a position A (as shown in FIGS. 2 and 5) aligned with the blade 23 as the photosensitive drum 7 rotates. At the position A, the blade 23 can be brought into contact with the photosensitive layer 11. The solenoid 57 is energized each time the photosensitive drum 7 makes one revolution. When the solenoid 57 of the solenoid-operated plunger 58 is energized, the lever 54 is angularly displaced counterclockwise (FIG. 7) about the pin 59 until the pawl 49 is disengaged from the tooth 48a. Rotative power is then transmitted from the sprocket wheel 42 through the spring clutch 43 to the rotatable disk 40, which is rotated in the direction of the arrow 52. The pin 39 turns the gear 37 while they are held in mutual engagement as shown in FIG. 11. Angular movement of the gear 37 causes the cam follower 34 and hence the support shaft 25 to move axially, whereupon the blade 23 is displaced axially of the photosensitive drum 7. As the gear 37 thus turns, the maximum-radius portion 60b of the cam face 60 of the rotatable disk 40 is brought into contact with the cam follower 61, whereupon the lever 65 is angularly moved counterclockwise (FIG. 5) about the shaft 66. Therefore, the pin 72 extending through the slot 68 in the second swing arm 64 the lever 70 to which the pin 72 is secured and shaft 25, through spring 76, are angularly moved clockwise (FIG. 5) about the axis of support shaft 25 until the blade 23 is brought into contact with the photosensitive layer 11 of the photosensitive drum 7. FIG. 12 shows the cam follower 61 being held against the maximum-radius portion 60b. The moment or the force tending to turn the support shaft 25 is transmitted from the lever 70 through the spring 76 to prevent the blade 23 from striking the photosensitive layer 11 with an undue force when the cam follower 61 is held against the maximum-radius portion 60b of the cam face 60. Accordingly, the photosensitive layer 11 is prevented from being subjected to damage which would otherwise be caused by the blade 23 hitting the photosensitive layer 11 with an excessive force. When maximum-radius portion 60b contacts cam follower 61, tooth 48b is brought into engagement with pawl 49 which is in the position 53. This interrupts further rotation of disk 40 and maintains blade 23 in contact with layer 11.

The solenoid 57 is de-energized when the residual toner is removed from the photosensitive layer 11 by the blade 23. The lever 54 and hence the pawl 49 are allowed to return by force of spring 55 to the solid-line position as shown in FIG. 7. The pawl 49 is then disengaged from the tooth 48b, whereupon disk 40 again rotates, and the cam follower 61 is brought out of contact with the maximum-radius portion 60b into contact with the minimum-radius portion 60a, whereupon the blade 23 is gradually spaced away from the photosensitive layer 11. The tooth 48a, as it angularly moves while the rotatable disk 40 makes a half revolution, again engages the pawl 49. A mass of toner 83 (FIG. 12) as collected by the blade 23 while the latter is in contact with the photosensitive layer 11 is moved along with the rotation of the photosensitive drum 7 as shown in FIG. 5 with the blade 23 lifted clear of the photosensitive layer 11 and is collected by a magnetic brush in the development unit 8.

Figure 13:
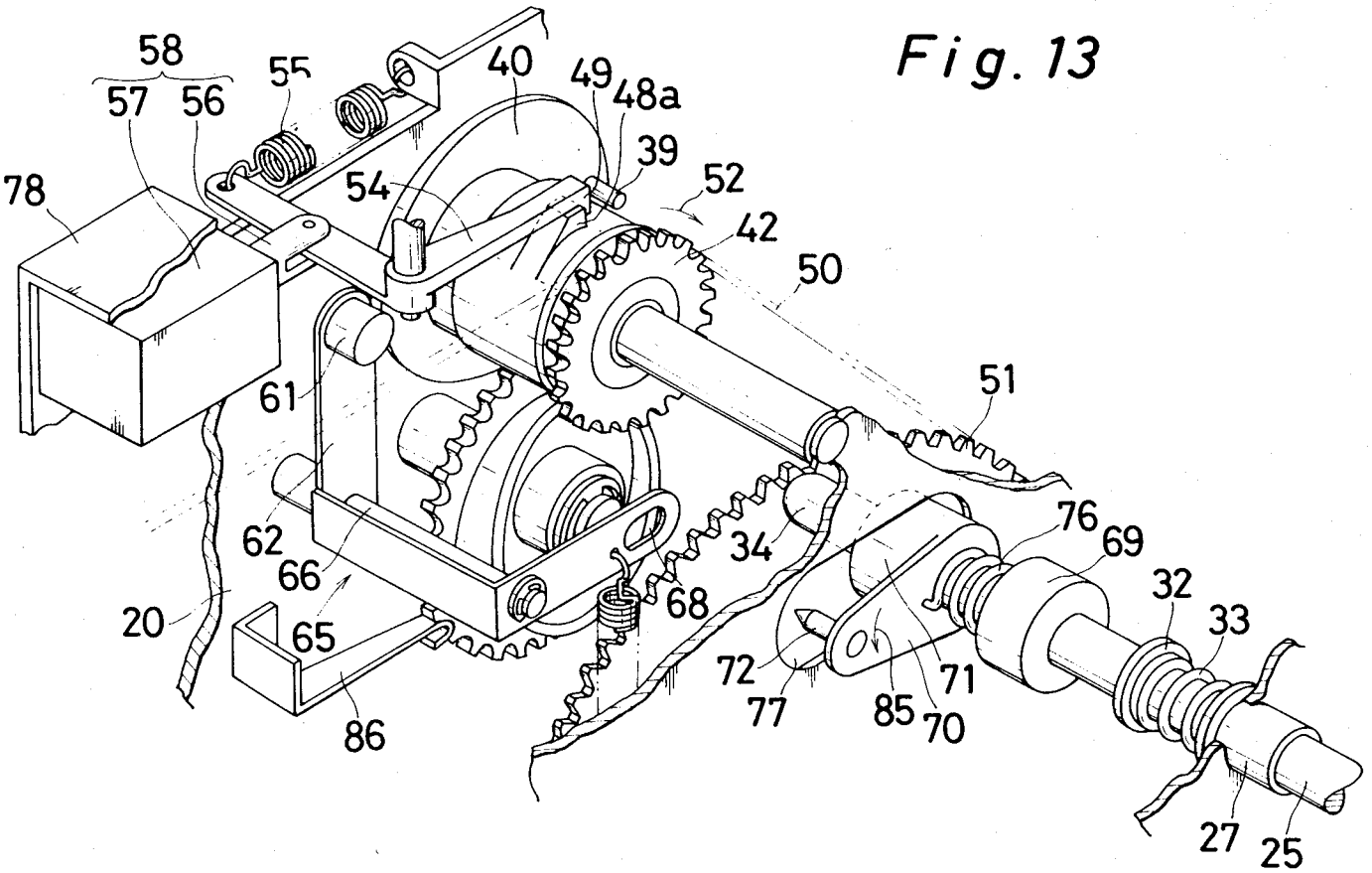
FIG. 13 is a perspective view illustrative of the manner in which a movable unit is pulled out of a machine frame.

When the movable unit 3 is to be pulled out of the machine frame 1, the pin 72 is brought out of the slot 68 in the second swing arm 64 of the lever 65 as illustrated in FIG. 13. The stopper 81 on the blade holder 24 remains in engagement with the stay 22 under the force of the spring 80, and hence the blade 23 is kept spaced away from the photosensitive layer 11. The lever 70 to which the pin 72 is secured is urged by the spring 76 to turn in the direction of the arrow 85 (FIG. 4) within an angular interval defined by the pin 75 and the cavities 73, 74. The lever 70 and the support shaft 25 are maintained in a relative constant angular relationship when the pin 72 is pulled out of the slot 68. Therefore, the lever 70 can easily pass through the hole 77 without interference.

The photosensitive drum 7 may be replaced with an endless belt with a photosensitive layer deposited thereon.

Although a certain preferred embodiment has been shown and described, it should be understood that the illustrated embodiment is by way of example only and that many changes and modifications may be made thereto without departing from the scope of the appended claims.

What is claimed is:

1. An apparatus for use in an electrostatic copying machine of the type having a movable photosensitive member, for cleaning residual toner from the photosensitive member, said apparatus comprising:

a cleaning blade adapted to be brought into sliding contact with the photosensitive member upon movement thereof;

a support shaft supporting said blade;

means for mounting said support shaft such that the longitudinal axis thereof extends orthogonally of the direction of movement of the photosensitive member and such that said support shaft is rotatable about said axis and is movable longitudinally thereof;

a rotational member rotatable about a first axis parallel to said longitudinal axis;

first means for converting rotation of said rotational member into longitudinal movement of said support shaft along said longitudinal axis, said first means comprising a face cam rotatable about a second axis parallel to said first axis, said face cam having a first cam face extending circumferentially around said second axis and of varying length in directions parallel thereto, a first cam follower on an end of said support shaft, means for urging said support shaft along said longitudinal axis such that said first cam follower is resiliently urged against said first cam face, a gear coaxially integral with said face cam, a disk rotatably mounted about said first axis, a pin located eccentrically on said disk to engage a tooth of said gear, and means for transmitting rotation of said rotational member to said disk, such that upon rotation of said disk, said pin rotates said gear and said face cam, and said face cam moves said support shaft axially against said urging means;

second means for converting rotation of said rotational member into angular movement of said support shaft about said longitudinal axis, said second means comprising an annular eccentric second cam face of said disk, said second cam face having a varying radial dimension, a pivotally mounted lever having first and second ends, means coupling said first lever end to said support shaft, and a second cam follower on said second lever end and urged against said second cam face, such that rotation of said disk pivots said lever, thereby rotating said support shaft about said longitudinal axis and moving said blade toward the photosensitive member; and third means for rendering inoperative said transmitting means, thereby preventing rotation of said disk.

2. An apparatus as claimed in claim 1, wherein said transmitting means comprises a clutch between said rotational member and said disk.

3. An apparatus as claimed in claim 2, wherein said third means comprises a solenoid operated plunger, and means operable by said plunger for preventing said clutch from transmitting rotation of said rotational member to said disk.

4. An apparatus as claimed in claim 3, wherein said preventing means comprises at least one tooth on said clutch, and a pawl pivotally mounted and operable by said plunger for movement to and from a position of engagement with said tooth.

5. An apparatus as claimed in claim 1, wherein said second cam face includes a minimum radius portion and a maximum radius portion, and said pin is secured to said disk adjacent said maximum radius portion.

6. An apparatus as claimed in claim 1, wherein said pivotally mounted lever includes first and second arms joined by a joint portion, said lever being mounted for rotation about a third axis parallel to said longitudinal axis, said second cam follower being on an outer end of said second arm, and further comprising resilient means for urging said lever to rotate about said third axis such that said second cam follower is urged against said second cam face.

7. An apparatus as claimed in claim 6, wherein said coupling means comprises a slot in said first arm and a pin mounted on said support shaft and extending through said slot.

* * * * *